United States Patent [19]

Johns

[11] Patent Number: 4,516,194

[45] Date of Patent: May 7, 1985

[54] PEN LIGHT

[75] Inventor: David L. Johns, Clearwater, Fla.

[73] Assignee: Suncoast Medical Manufacturing Co., Clearwater, Fla.

[21] Appl. No.: 619,622

[22] Filed: Jun. 11, 1984

[51] Int. Cl.[3] ..... F21L 7/00

[52] U.S. Cl. ..... 362/202; 362/205; 362/206; 362/295; 200/60

[58] Field of Search ..... 362/202, 205, 295, 109, 362/119, 120, 206; 200/60

[56] References Cited

U.S. PATENT DOCUMENTS

| | | | |
|---|---|---|---|
| 2,134,856 | 11/1938 | Burgess | 362/205 |
| 3,226,502 | 12/1965 | Schotz | 362/205 X |
| 3,737,650 | 6/1973 | Kaye et al. | 362/205 X |
| 3,806,724 | 4/1974 | Tanner et al. | 362/189 |
| 4,347,553 | 8/1982 | Saron | 362/189 |
| 4,408,263 | 10/1983 | Sternlicht | 362/206 |

*Primary Examiner*—Peter A. Nelson

*Attorney, Agent, or Firm*—Arthur W. Fisher, III

[57] ABSTRACT

A pen light comprising a hollow substantially cylindrical housing having a retainer member secured to the rear portion thereof to house a single voltage source in operative engagement with a light source, a first conductor member movable between a first and second position and a second conductor member each disposed within the hollow substantially cylindrical housing to operatively engage the light source and the voltage source respectively and an actuator clip attached to the hollow substantially cylindrical housing movable between a first and second position to selectively engage the first conductor member such that when the actuator clip is in the first position the first conductor member is separated from the second conductor member to form an open circuit and when the actuator clip is in the second position the actuator clip engages the first conductor member to move the first conductor member from the first position to second position whereby the first conductor member engages the second conductor member to close the circuit and activate the light source.

18 Claims, 3 Drawing Figures

PEN LIGHT

BACKGROUND OF THE INVENTION

1. Field of the Invention

A pen light comprising a substantially cylindrical housing having a retainer member secured to the rear portion thereof to house a voltage source in operative engagement with a light source and having an actuator clip movable between a first and second position to selectively actuate the light source when in the second position.

2. Description of the Prior Art

A number of pen lights or pocket flashlights comprising a current or voltage source in combination with a light bulb and switch to actuate/deactuate the flashlight to provide an inexpensive light source which may be easily carried on the person have been developed for use in the medical field and similar endeavors.

The switch may comprise a plunger type switch similar to those used in mechanical pencils and ball point pens in which the switch is axially aligned with the power source and light bult to move the power source into and out of operative engagement with the light source itself. Several working parts with attendant manufacturing and assembly the plunger type switch is unfortunately subject to wear and malfunction rendering the device inoperable.

A second type of switching comprises a clip-like member attached to or between the voltage/current source and a conductive member operatively coupled to the bult. The clip-like member has a first and second position such that the member may be moved into and out of closed and open circuit configuration. These clip-like members often move to the closed position causing inadvertent current or voltage drain significantly reducing the useful life of the flashlight.

Examples of the prior art are found in U.S. Pat. Nos. 1,182,965; 1,219,109; 3,063,024; 3,648,224; 3,806,724 and 3,902,058.

The instant invention obviates the need for a conductor tube, conductor/clip can combination and two batteries generally found in the prior art.

SUMMARY OF THE INVENTION

The present invention relates to a pen light comprising a hollow substantially cylindrical housing having a retainer member secured to the rear portion thereof to retain a single voltage source in operative engagement with a light source. The forward portion of the hollow substantially cylindrical housing comprises a substantially conical recess to retain the light source within the forward portion of the hollow substantially cylindrical housing. The hollow substantially cylindrical housing further includes an actuator clip aperture formed on the mid or rear portion thereof.

A first conductor member comprising an elongated conductor strip having a first and second contact element formed on opposite ends thereof and second conductor member comprising a spiral element or spring bias member to bias the single voltage source into operative engagement with the light source are operatively disposed within the hollow substantially cylindrical housing. An actuator clip attached to the hollow substantially cylindrical housing is movable between a first and second position to selectively engage the rear portion of the first conductor member to actuate the light source as more fully described hereinafter.

In operation, the first conductor member is normally separated from the second conductor member to form an open circuit. To actuate the pen light, the actuator clip is depressed to the first conductor member moving the first conductor member from the first to second position to engage the second conductor member completing the circuit thereby actuating the light source.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
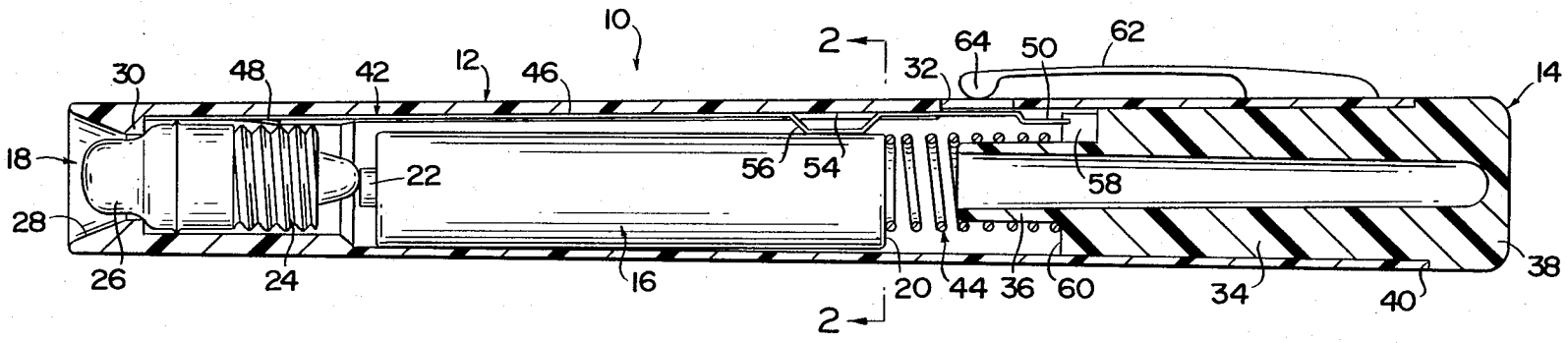
FIG. 1 is a cross-sectional side view of the pen light.

As shown in FIG. 1, the present invention relates to a pen light generally indicated as 10 comprising a hollow substantially cylindrical housing 12 having a retainer member 14 secured to the rear portion thereof house a single voltage source 16 in operative engagement with a light source 18. The single voltage source 16 includes a base and terminal 20 and 22 respectively formed on opposite ends thereof while the light source 18 includes a base and bulb 24 and 26 respectively formed on oppsite ends thereof such that the terminal 22 engages the base 24. The forward portion of the hollow substantially cylindrical housing 12 comprises a substantially conical reset 28 relating in retainer shoulder 30 to engage the bulb 26 to retain the light source 18 within the foward portion of the hollow substantially cylindrical housing 12. The hollow substantially cylindrical housing 12 further includes an actuator clip aperture 32 formed on the rear portion thereof.

The retainer member 14 comprises an enlarged retainer body 34 having a retainer post 36 formed on the inner end thereof. An enlarged cap 38 formed on the opposite end thereof to form shoulder 40 such that the retainer member 14 is press-fitted into the read end of the hollow substantially cylindrical housing 12. To further insure the security therebetween the retainer member 14 may be bonded to the hollow substantially cylindrical housing 12.

Figure 3:
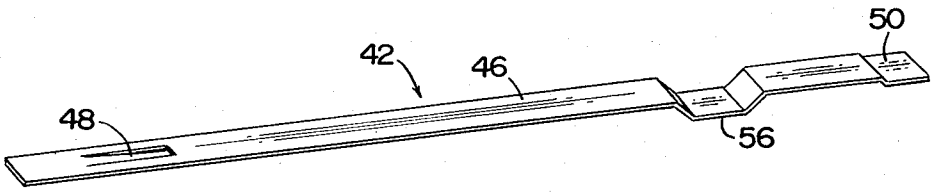
FIG. 3 is a perspective view of the elongated conductor strip.
Figure 2:
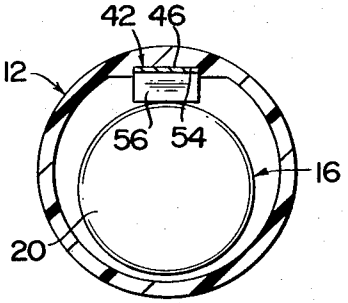
FIG. 2 is a cross-sectional view of the pen light taken along line 2—2 of FIG. 1.

A first and second conductor member generally indicated as 42 and 44 respectively are operatively disposed within the hollow substantially cylindrical housing 12. As best shown in FIGS. 1 and 3, the first conductor member 42 comprises an elongated conductor strip 46 having a first and second contact element 48 and 50 respectively formed on opposite ends thereof. The elongated conductor strip 46 operatively engages with groove 54 formed on the inner surface of the hollow substantially cylindrical housing 12 to insure longitudinal alignment of the elongated conductor strip 46 relative to the actuator clip aperture 32. Formed on the opposite side of the elongated conductor strip 46 is an alignment cam 56 to engage the rear portion of the single voltage source 16 such that the single voltage source 16 and light source 18 are offset in longitudinal alignment relative to each other. The first contact element comprises a flexible member extending rearwardly from the forward portion of the elongated conductor strip 46 to be biased to contact with the base 24 of the light source 18 while the second contact element is offset inwardly relative to the longitudinal dimension of the elongated conductor strip and normally disposed within retainer contact recess 58 formed on the inner portion of the retainer body 34. The second contact member 44 comprises a spiral element or spring bias operatively mounted on the retainer post to bias the single voltage source 16 into operative engagement with the light source 18 by engagement between the inner portion of the retainer body 60 the base 20 of the single voltage source 16. Actuator clip 62 is affixed to the rear portion of the hollow substantially cylindrical housing 12 extends forwardly such that its forward portion or contact actuator 64. The actuator clip 64 being movable between a first and second position to selectively engage the rear portion of the elongated conductor strip 46 to actuate the light source 18 as more fully described hereinafter.

In operation, the second contact element 50 is normally separated from the second conductor member 44 to form an open circuit. To actuate the pen light 10, the actuator clip 62 is depressed such that the contact actuator 64 engages the elongated conductor strip 46 moving the second contact element 50 from the first to second position to engage the second conductor member 44 depressed such that the contact actuator 64 engages the elongated conductor strip 46 through the actuator clip aperture 32 moving the second contact element 50 from the first to second position to engage the second conductor member 44 completing the circuit thereby actuating the light source 18.

It will thus be seen that the objects set forth above, and those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described, I claim:

1. A pen light comprising a hollow housing having a retainer member secured to the rear portion thereof to house a voltage source in operative engagement with a light source, a first conductor member movable between a first and second position and a second conductor member each disposed within said hollow housing to operatively engage said light source and said voltage source respectively and an actuator clip attached to said hollow housing adjacent an actuator clip aperture formed on said hollow housing, said first conductor member comprising an elongated conductor strip including a first contact element to operatively engage said light source and a second contact element disposed to selectively engage said second conductor member when said first conductor member is in said second position, said hollow housing further includes a longitudinally disposed groove formed on the inner surface thereof corresponding to said elongated conductor strip to receive said elongated conductor strip therein to align said elongated conductor strip longitudinally relative to said actuator clip aperture and said actuator clip, said actuator clip being movable between a first and second position to selectively engage said first conductor member such that when said actuator clip is in said first position said first conductor member is separated from said second conductor member to form an open circuit and when said actuator clip is in said second position said actuator clip engages said first conductor member to move said first conductor member from said first position to said second position whereby said first conductor member engages said second conductor member to close the circuit and actuate said light source.

2. The pen light of claim 1 wherein said second contact element is offset inwardly relative to the longitudinal dimension of said elongated conductor strip.

3. The pen light of claim 1 wherein said elongated conductor strip includes an alignment cam disposed to engage said voltage source to maintain alignment of said voltage source relative to said light source.

4. The pen light of claim 1 wherein said actuator clip is affixed to the outer portion of said hollow housing movable between a first and second position to operatively engage said elongated conductor strip when in said second position to move said second contact element into operative engagement with said second conductor member to complete the circuit.

5. The pen light of claim 1 wherein said retainer member includes a retainer contact recess disposed adjacent said actuator clip aperture to receive said second contact element therein to permit movement of said second contact element from said first to said second position when said actuator clip is moved from said first position to said second position.

6. The pen light of claim 1 wherein said retainer member includes a retainer body having a retainer post extending inwardly from the inner portion thereof to engage said second conductor member to retain said second conductor member in operative relationship to said voltage source.

7. The pen light of claim 1 wherein said hollow housing includes a conical recess formed in the forward portion of said pen light, said conical recess terminating in a shoulder to retain the light source within said hollow housing.

8. The pen light of claim 1 wherein said first contact element comprises a member extending inwardly from the forward portion of said elongated conductor strip to be biased in operative engagement with said light source.

9. The pen light of claim 3 wherein said alignment cam is inwardly offset relative to said hollow housing.

10. A pen light comprising a hollow housing having a retainer member secured to the rear portion thereof to house a voltage source in operative engagement with a light source, a first conductor member movable between a first and second position and a second conductor member each disposed within said hollow housing to operatively engage said light source and said voltage source respectively and an actuator clip attached to said hollow housing adjacent an actuator clip aperture formed on said hollow housing, said first conductor member comprising an elongated conductor strip including a first contact element to operatively engage said light source and a second contact element disposed to selectively engage said second conductor member when said first conductor member is in said second position, said second conductor member comprising a spiral bias spring and said retainer member comprising a retainer body disposed within said hollow housing having a reduced diameter post extending inwardly therefrom to receive said spiral bias spring to maintain said spiral bias spring in engagement with said voltage source, said actuator clip being movable between a first and second position to selectively engage said first conductor member such that when said actuator clip is in said first position said first conductor means is separated from said second conductor member to form an open circuit and when said actuator clip is in said second position said actuator clip engages said first conductor member to move said first position to said second position whereby said first conductor member engages said second conductor member to close the circuit and actuator said light source.

11. The pen light of claim 10 wherein said first contact element comprises a member extending inwardly from the forward portion of said elongated conductor strip to be biased in operative engagement with said light source.

12. The pen light of claim 10 wherein said second contact element is offset inwardly relative to the longitudinal dimension of said elongated conductor strip.

13. The pen light of claim 10 wherein said hollow substantially cylindrical housing includes a longitudinally disposed groove formed on the inner surface thereof to receive said elongated conductor stip therein to align said elongated conductor strip longitudinally relative to said actuator switch.

14. The pen light of claim 10 wherein said elongated conductor strip includes an alignment cam disposed to engage said voltage source to maintain longitudinal alignment of said voltage source relative to said light source.

15. The pen light of claim 14 wherein said alignment cam is inwardly offset relative to said hollow housing.

16. The pen light of claim 10 wherein said retainer member includes a retainer contact recess disposed adjacent said actuator clip aperture to receive said second contact element therein to permit movement of said second contact element from said first to said second position when said actuator clip is moved from said first position to said second position.

17. The pen light of claim 10 wherein said hollow housing includes a conical recess formed in the forward position of said pen light, said conical recess terminating in a shoulder to retain the light source within said hollow housing.

18. The pen light of claim 10 wherein said actuator clip is affixed to the outer portion of said hollow housing movable between a first and second position to operatively engage said elongated conductor strip when in said second position to move said second contact element into operative engagement with said second conductor member to complete the circuit.

* * * * *